US007516719B2

(12) United States Patent
Kral et al.

(10) Patent No.: US 7,516,719 B2
(45) Date of Patent: Apr. 14, 2009

(54) CONTINUOUS STEAM GENERATOR

(75) Inventors: Rudolf Kral, Stulln (DE); Andre Schrief, Erlangen (DE); Frank Thomas, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 117 days.

(21) Appl. No.: 10/579,997

(22) PCT Filed: Oct. 26, 2004

(86) PCT No.: PCT/EP2004/012102

§ 371 (c)(1),
(2), (4) Date: May 19, 2006

(87) PCT Pub. No.: WO2005/050089

PCT Pub. Date: Jun. 2, 2005

(65) Prior Publication Data

US 2007/0144456 A1 Jun. 28, 2007

(30) Foreign Application Priority Data

Nov. 19, 2003 (EP) ..... 03026647

(51) Int. Cl.
*F22B 25/00* (2006.01)

(52) U.S. Cl. ..... 122/6 A; 122/235.12

(58) Field of Classification Search ..... 122/7 R, 122/235.12, 235.14, 265, 511, 512, 235.32, 122/406.4, 235.26, 1 B, 6 A, 332
See application file for complete search history.

(56) References Cited

U.S. PATENT DOCUMENTS 3,662,716 A * 5/1972 Stevens ..... 122/235.14
3,872,836 A * 3/1975 Gorzegno et al. ..... 122/406.4
4,465,023 A * 8/1984 Wagner ..... 122/235.12
4,537,156 A * 8/1985 Rees ..... 122/235.12
4,726,323 A * 2/1988 Rees ..... 122/6 A
4,782,793 A * 11/1988 Salem ..... 122/6 A
4,944,250 A * 7/1990 Seshamani ..... 122/20 B
4,987,862 A * 1/1991 Wittchow et al. ..... 122/6 A
5,056,468 A * 10/1991 Wittchow et al. ..... 122/406.4
5,226,936 A * 7/1993 Garkawe ..... 55/434.4
5,687,676 A * 11/1997 Kai et al. ..... 122/6 A
5,701,850 A 12/1997 Köhler et al.
5,755,188 A * 5/1998 Phelps ..... 122/511
5,979,369 A * 11/1999 Wittchow et al. ..... 122/235.12
5,979,370 A * 11/1999 Franke ..... 122/235.14
6,189,491 B1 2/2001 Wittchow et al.

FOREIGN PATENT DOCUMENTS

EP 0 543 564 A1 5/1993
FR 2 414 705 8/1979
WO WO 2006032556 A1 * 3/2006

* cited by examiner

*Primary Examiner*—Gregory A Wilson

(57) ABSTRACT

A steam generator comprising a combustion chamber having funnel-shaped side walls in the bottom area thereof and an encircling wall formed from a plurality of steam generator pipes through which a flow medium can flow, wherein there area as little temperature differences as possible in the flow medium at the output of the steam generator pies. The steam generator pipes are, more particularly, arranged in the lower section forming the funnel-shaped side walls such that they are exposed to heat in as homongenous a manner as possible. According to the invention, the diameter of a number of steam generator pipes in the region of the funnel shaped side walls is different from that in the region of the encircling wall.

15 Claims, 2 Drawing Sheets

CONTINUOUS STEAM GENERATOR

CROSS REFERENCE TO RELATED APPLICATIONS

This application is the US National Stage of International Application No. PCT/EP2004/012102, filed Oct. 26, 2004 and claims the benefit thereof. The International Application claims the benefits of European Patent application No. 03026647.2 filed Nov. 19, 2003. All of the applications are incorporated by reference herein in their entirety.

FIELD OF THE INVENTION

The invention relates to a steam generator with a combustion chamber which has funnel-shaped side walls in its bottom area, and with an encircling wall formed from steam generator pipes welded to each other in a gas-tight manner.

BACKGROUND OF THE INVENTION

A steam generator can be designed in accordance with different layout principles. In a continuous steam generator the heating of a number of steam generator pipes which together form the gas-tight enclosing wall of the combustion chamber leads to a complete evaporation of a flow medium in the steam generator pipes in one operation. The flow medium—usually water—is fed after its evaporation to the superheater pipes downstream from the steam generator pipes and is superheated there.

A continuous steam generator, by contrast with a natural circulation steam generator, is not subject to any pressure limiting, so that it can be designed for fresh steam pressures far above the critical pressure of water ($P_{crit}$=221 bar)—with no distinction being possible between the water and stream phase and thereby no phase separation being possible either. A higher fresh steam pressure facilitates a greater efficiency and thereby lower $CO_2$ emissions in a fossil-fueled power station.

For steam generators with a vertical gas draft the steam generator pipes are generally connected to each other via fins The encircling wall is thus formed from a number of approximately parallel steam generator pipes which are connected to each other via fins and welded so as to be gas-tight. The steam generator pipes of the steam generator can be arranged vertically or in a spiral form and thereby inclined.

Funnel-shaped side walls of the combustion chamber are usually arranged at the lower end of the gas draft pipe, said walls being formed to allow the uncomplicated removal of ash occurring during the combustion process. In this case the combustion chamber wall is generally formed from vertical steam generator pipes and fins. In the lower section, in the area of the funnel, the steam generator pipes usually also run on in the manner of vertical pipework in the same direction as in their upper section forming the combustion chamber wall. The parallel pipes enter the funnel in this case via entry collectors and in the continuation of the parallel pipes form the combustion chamber.

During the operation of a continuous steam generator, the heat generated during the combustion of a combustion gas within the combustion chamber is entered both directly via the walls of the steam generator pipes and also via the fins into the flow medium flowing through the steam generator pipes. In this case the heating steam generator pipe determines the weight of the column of water in the relevant pipe. Since the throughflow of flow medium through a steam generator pipe and thereby the output temperature of the flow medium depends on the pressure of the column of water in the corresponding pipe, the output temperature through a steam generator pipe will be decisively influenced by the heating of the corresponding steam-generator pipe.

If the steam generator pipes are heated by different degrees, the result is thus different output temperatures of the flow medium. Under some circumstances—especially during startup processes and at low loads—such temperature differences can reach a high value, in which impermissibly high loads are imposed on materials.

For steam-generator pipes running in the combustion chamber wall and in the area of the funnel-shaped side walls, there are a number of steam generator pipes and the associated fins in the area of the funnel-shaped side walls, namely those which, for a rectangular cross-section of the combustion chamber lie in the area of the four corners, which are shorter than those which form the tip of the funnel-shaped side walls. Because of their different length the steam generator pipes and the fins are thus subjected to different levels of heating. There is thus the danger, on account of the different levels of heating of the steam generator pipes in the area of the funnel-shaped side walls, of impermissibly high temperature differences of the flow medium leaving the individual steam-generator pipes arising.

SUMMARY OF THE INVENTION

The object of the invention is thus to specify a steam generator of the above-mentioned type in which, in each operating state it is ensured that the differences in the temperatures of the flow medium leaving individual steam generator pipes does not exceed a critical value.

In accordance with the invention this object is achieved by a number of steam generator pipes in the area of the funnel-shaped side walls having a different external pipe diameter and/or fin width to that in the area of the encircling wall of the combustion chamber.

The invention is thus based on the idea that high material loads imposed on the steam generator pipes can be avoided by ensuring that the temperature differences of the flow medium at the output of individual steam generator pipes does not exceed a critical value. Therefore the heating of a steam generator pipe should not deviate significantly from the heating of the other steam generator pipes at any point in the steam generator. In the area of the funnel-shaped side wall of the combustion chamber however, with conventional construction, the length of the steam generator pipes must be varied as the funnel narrows. This means that a few steam generator pipes are shorter than others and are thus subjected to weaker heating in the area of the funnel-shape side walls. With conventional construction therefore variations in heating of steam generator pipes and fins as a result of the geometrical circumstances in their section arranged in the lower area of the funnel-shaped side walls cannot be avoided. To ensure that the heating of the individual steam generator pipes does not differ too much despite the necessary narrowing of the funnel-shaped side walls, the lengths of the individual steam generator pipes should not differ too greatly from one another. To make this possible the steam generator pipes in the area of the funnel-shaped side walls should be routed along its side surfaces. This is made possible by a suitable choice of pipe geometries.

The steam generator is advantageously designed in this case as a continuous steam generator. Advantageously a number of steam generator pipes in the lower section forming the funnel-shaped side walls have a smaller pipe diameter than in the upper section forming the combustion chamber wall. The reduction of the pipe diameter in the funnel-shaped side walls allows this pipework with the same number of steam generator tubes as in the upper section forming the combustion chamber wall. In other words: The narrowing of the funnel-shaped side walls is taken into account not by reducing the number of steam generator pipes but by reducing the diameter of the pipes. This means that all steam generator pipes run for approximately the same length in the heated area and a comparable heating of all steam generator pipes is ensured.

The heat is input into the flow medium not only through the pipe walls but also by the fins connecting the individual steam generator pipes to each other. The width of the combustion chamber wall and the funnel-shaped side walls is produced by the number of the steam generator pipes multiplied by the distance between the pipe axes, with the distance from pipe axis to pipe axis being the same as the pipe diameter added to the width of a fin. To take account of the narrowing of the funnel-shaped side walls the width of the fins in the lower section of the steam generator pipes forming the funnel-shaped side can thus advantageously be changed and especially reduced.

Advantageously the pipe diameter in the lower section is reduced by 5 to 15 percent compared to the pipe diameter in the upper section. The fin width is advantageously reduced in the lower section by 30 to 70 percent compared to the width in the upper section. As has namely been emphasized, this method enables an especially effective utilization of the heat available in the lower section of the steam generator pipes forming the funnel-shaped side walls to be obtained.

In the area of the funnel-shaped side walls a number of steam generator pipes are advantageously arranged at least partly in parallel to the direction of inclination of the funnel-shaped side walls. Such an arrangement allows an especially good adaptation of the length of each individual steam generator pipe to the heating conditions and thereby an especially even heating. It is especially possible with such an arrangement for example to arrange a less strongly heated steam generator pipe so that it has a greater length within the heated area, and in this way to compensate for the effect of a weaker heating by heating over a greater length.

The advantages obtained with the invention lie in particular in that fact that, if the steam generator is designed as a continuous steam generator, the occurrence of impermissibly large temperature differences in individual steam generator pipes can be effectively avoided with a comparatively low constructional overhead. Because especially in the lower section of the steam generator pipes forming the funnel-shaped side walls all steam generator pipes are subjected to a similarly strong heating, even if the steam generator is supplied with a lower mass flow density, very great differences in throughflow rates and thereby also impermissibly high temperature differences of the flow medium at the output of the steam generator pipes cannot arise.

On the other hand, when the steam generator is designed for continuous steam generation, almost the same mass flows and thus a good cooling for the steam generator pipes and in addition almost the same amounts of steam in the steam generator pipes can be obtained.

BRIEF DESCRIPTION OF THE DRAWINGS

An exemplary embodiment of the invention is explained in more detail below with reference to a drawing. The Figures show.

The same parts are shown by the same reference symbols in all the Figures.

DETAILED DESCRIPTION OF THE INVENTION

Figures 1A, 1B:
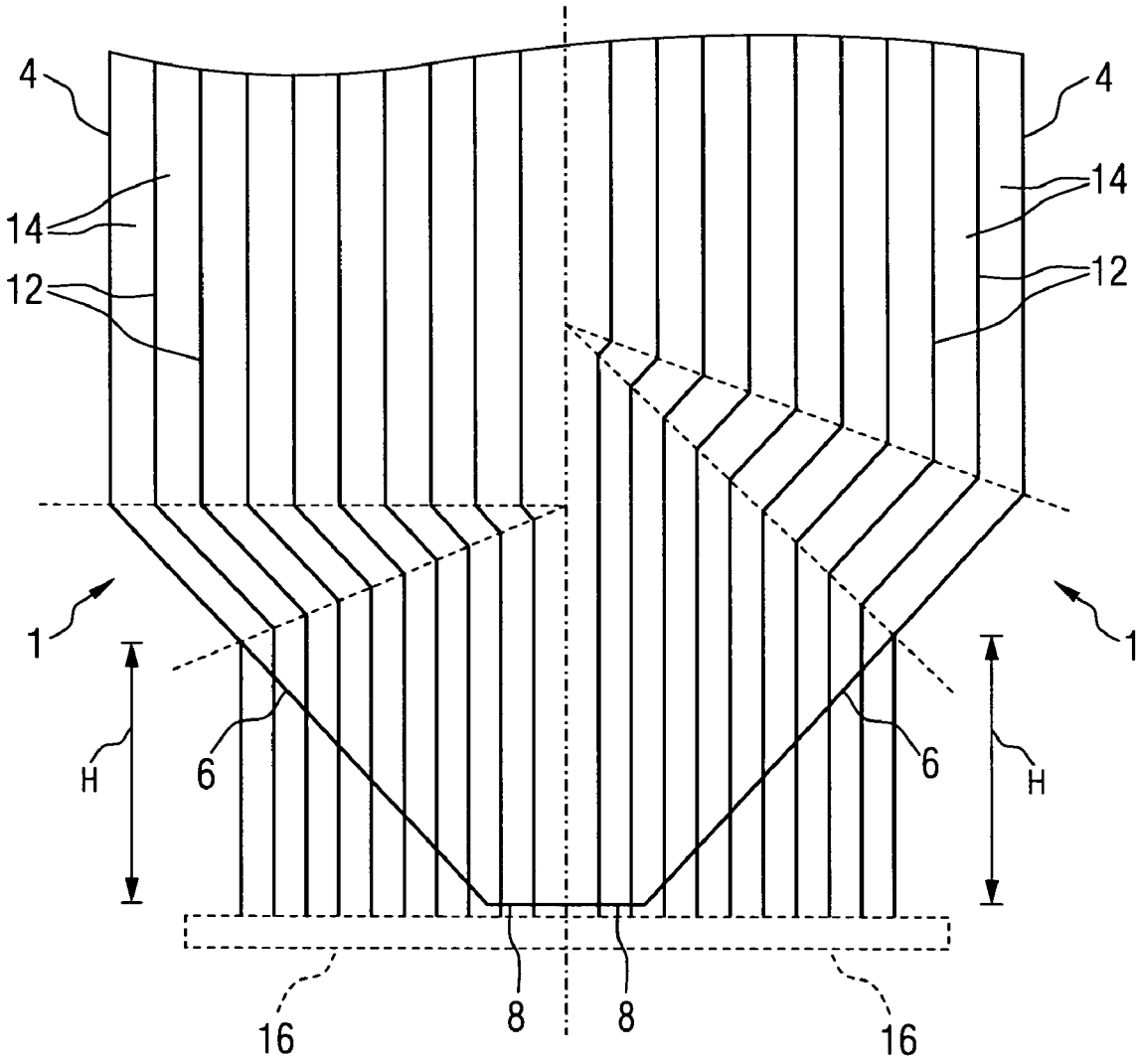
FIG. 1*a* a schematic diagram of a continuous steam generator with vertically-arranged evaporator pipes in the area of the combustion chamber wall and steam generator pipes arranged partly in parallel to the direction of inclination of the bottom in the area of the bottom, FIG. 1*b* an alternate embodiment of the continuous steam generator, and FIG. 2 a further alternate embodiment of the steam generator shown in FIG. 1.

FIG. 1*a* shows a schematic diagram of a steam generator 1 embodied as a continuous steam generator, of which the vertical gas draft is surrounded by an encircling wall 4 and forms a combustion chamber which changes at its lower end into a bottom area formed by funnel-shaped side walls 6. The bottom includes a discharge opening 8 for ash, not shown in any greater detail in the diagram.

In the area of the gas draft a number of burners not shown are accommodated in the encircling wall 4 of the combustion chamber formed from vertically-arranged steam generator pipes 12. The steam generator pipes 12 arranged to run vertically are welded to each other via fins 14 and, together with the fins 14, form the encircling wall 4 of the combustion chamber in their upper section. Below the bottom area an inlet header 16 is arranged from which the steam generator pipes 12 are supplied with flow medium.

In the combustion chamber there is a flame volume which is produced during operation of the steam generator 1 when a fossil fuel is burnt. The heat generated in this way in the combustion chamber is transmitted to the flow medium flowing through the steam generator pipes 12, where it causes the flow medium to evaporate. In this case the heat is applied both directly via the pipe walls of the steam generator pipes 12 and also via the fins 14.

The throughflow rate of the flow medium through the individual steam generator pipes 12 or the distribution of the throughflow to the individual steam generator pipes 12 respectively is greatly determined by the relevant weights of the columns of water in the individual steam generator pipes 12. The result of this is that heating which is undertaken in lower part of the combustion chamber, especially in the area of the funnel-shaped side walls 6, greatly affects the flow through the steam generator pipes 12. If individual heat generator pipes 12 are comparatively strongly heated, the weight of their column of water and thereby also the resistance in the heat generator pipe 12 concerned falls. This then increases the throughflow rate in this steam generator pipe 12 by comparison with other less strongly heated steam generator pipes 12. If a steam generator pipe 12 is comparatively weakly heated, the throughflow rate reduces accordingly.

If a steam generator pipe 12 in the area of the funnel-shaped side walls is comparatively weakly heated. for example because it only enters the heated area at the upper edge of the funnel-shaped side walls and thereby has a comparatively small length within the heated area, it exhibits a lower throughflow rate by comparison with other comparatively strongly heated steam generator pipes 12 which have a greater length within the heated area. In the upper section of the steam generator pipes 12 which form the encircling wall 4 of the combustion chamber, all steam generator pipes 12 are subjected to similar heating. A steam generator pipe 12 with a comparatively low throughflow rate will under these conditions accept more heat than one with a comparatively high throughflow rate, so that the different heating of the steam generator pipe 12 in the area of the funnel-shaped side walls 6 under some circumstances causes significant differences in the output temperature of the flow medium to occur.

Such temperature differences are only tolerable within specific limits since they can lead to stresses which may not be exceeded by a value predetermined for the permissible material loads on the steam generator pipes 12. As even as possible a heating of all steam generator pipes 12 is therefore the aim and is especially important in the lower section of the steam generator pipes 12 forming the funnel-shaped side walls 6.

To obtain as even as possible a heating of all steam generator pipes 12 the steam generator pipes 12 of the steam generator 1 in FIG. 1*a* have a smaller diameter in the lower section forming the funnel-shaped side walls 6 than in the upper section forming the encircling wall 4 of the combustion chamber. The fins 14 also have a narrower width in the lower section than in the upper section. Thus the width of the bottom, which is determined by the number of parallel steam generator pipes 12 and by the pipe diameter added to the width of a fin 14 is able to be reduced by a smaller pipe diameter and a narrower width of the fins 14 instead of by a reduction of the number of the parallel steam generator pipes 12. The required narrowing of the bottom area is thus achieved in the manner of an at least partial routing of the steam generator pipes along the bottom area.

As has been emphasized, an optimal arrangement of the steam generator pipes 12 and thereby an especially effective utilization of the heat available in the area of the funnel-shaped side walls can be achieved if the diameter of each steam generator pipe 12 in the lower section is reduced by 5 to 15 percent compared to the pipe diameter in the upper section and the width of the fins 14 in the lower section is reduced by 30 to 70 percent compared to the width in the upper section. For a normal pipe diameter of 34 mm and a fin width of 16 mm a pipe diameter of approximately 32 mm and a fin width of appr. 6 mm is thus produced in the lower section.

An especially even heating of the steam generator pipes 12 in the area of the funnel-shaped side walls 6 can be achieved by the steam generator pipes 12 being arranged in their lower section as shown in FIG. 1*a*, partly not parallel to the direction of inclination of the bottom area. This angled arrangement allows the strength of the heating of each steam generator pipe 12 to be largely adapted to its length within the heated area. In other words: The comparatively weak heating of a steam generator pipe 12 is compensated for by a greater length made possible by the angled arrangement of the steam generator pipe 12 in the heated area.

The arrangement of the steam generator pipes 12 in the bottom area can in this case be adapted to the temperature profile present in this area. FIG. 1*a* shows an arrangement in which the steam generator pipes 12 in their lower section in which the pipe diameter is reduced, are arranged at an angle—that is are not parallel to the angle of inclination of the bottom area. In this arrangement, up to a certain height H determined by the geometry and the dimensions of bottom area, fins 14 and steam generator pipes 12, an arrangement of the steam generator pipes 12 in parallel to the angle of inclination of the bottom area is provided. Above this height H the angled arrangement described is provided.

As an alternative to this the steam generator pipes 12 can also be arranged as is shown in FIG. 1*b*. In this case piping with steam generator pipes 12 arranged in parallel to the direction of inclination of the bottom is also provided up to a certain height H with a pipe diameter reduced compared to the diameter in the upper section. Above this height H, as in the first example an angled arrangement of the steam generator pipes 12 is provided, which the angle of inclination of the steam generator pipes 12 however being selected compared to their original direction in the plane of the bottom so that the steam generator pipes 12 as well as the fins 14, have the same pipe diameter or the same width respectively in their angled section as in the upper section. The pipe diameter and the fin width are thus only reduced in this case up to the height H.

Figure 2:
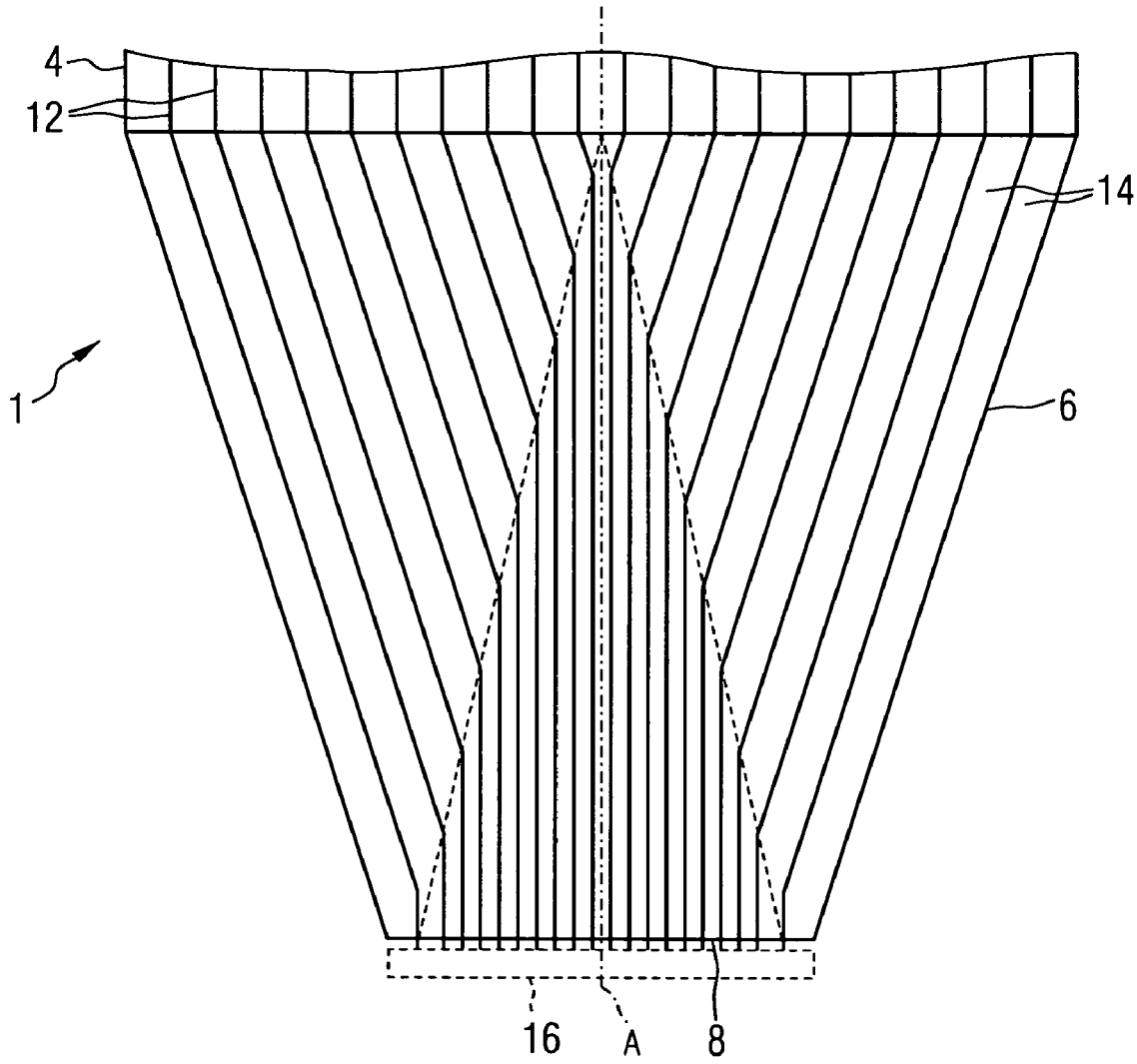

If the inlet header 16 is comparatively wide and if the outer steam generator pipes are a comparatively long distance from each other, as is the case for example for steam generators with circulating fluidized solids, the steam generator pipes 12 can be arranged as shown in FIG. 2. With this arrangement the outermost steam generator pipes 12, that is those steam generator pipes 12 which are at the greatest distance from the center axis A, are arranged over the entire height of the funnel-shaped side walls 6 both with non-reduced pipe diameter and non-reduced width and also at an angle. The innermost steam generator pipes 12 with the smallest distance from the center axis A on the other hand are embodied over their entire length with a reduced pipe diameter and reduced width and arranged in parallel to the center axis A and thereby to the direction of inclination of the bottom. The steam generator pipes 12 arranged in each case between the outermost and the innermost steam pipes 12 form the transition and in each case have a first section with reduced pipe diameter and reduced fin width in which they are arranged in parallel to the center axis, and a second section with the non-reduced pipe diameter and non-reduced fin width in which they are arranged at an angle and thereby parallel to the outermost steam generator pipe 12.

With this arrangement the differences in the strength of the heating of the steam generator pipes 12 in the area of the bottom are insignificantly small and any temperature differences which might possibly result in the flow medium are so small that impermissibly high loads on materials can be safely avoided. No additional measures are therefore required even at low loads and during startup processes to keep the temperature differences low.

The invention claimed is:

1. A steam generator, comprising:

a combustion chamber having funnel shaped side walls, a bottom area, and a top area;

a plurality of steam generator pipes, connected together by fins, at least one of the pipes having a diameter at the bottom area that is different than a diameter at the top area;

an encircling wall arranged between the bottom and top areas and above the funnel shaped side walls formed from the plurality of steam generator pipes;

a flow medium that flows through the steam generator pipes;

a center axis A, positioned at the center of the encircling wall and extending parallel to the direction of flow of the flow medium, wherein the outermost steam generator pipes which are the greatest distance from the center axis A are arranged over the entire height of the funnel shaped side walls both with non-reduced pipe diameter and a non-reduced fin width, wherein inner most steam generator pipes with the smallest distance from the center axis A have a reduced pipe diameter and reduced fin width, and steam generator pipes arranged between the outermost and the innermost steam generator pipes form a transition having a first section with reduced pipe diameter and reduced fin width and a second section with non-reduced pipe diameter and non-reduced fin width.

2. The steam generator as claimed in claim 1, wherein a majority of steam generator pipes have a diameter at the bottom area that is different than a diameter at the top area.

3. The steam generator as claimed in claim 2, wherein all of the steam generator pipes have a diameter at the bottom area that is different than a diameter at the top area.

4. The steam generator as claimed in claim 3, wherein a plurality of steam generator pipes have a smaller pipe diameter in the bottom area than in the top area.

5. The steam generator as claimed in claim 4, wherein adjacent steam generator pipes are connected via fins, and a plurality of the fins in the top area have a different width than in the bottom area.

6. The steam generator as claimed in claim 5, wherein a plurality of fins in the bottom area have a narrower width than in the top area.

7. The steam generator as claimed in claim 6, wherein the diameter of the plurality of steam generator pipes in the bottom area is reduced by 5 to 15 percent relative to the pipe diameter in the top area.

8. The steam generator as claimed in claim 7, wherein the width of a plurality of fins in the bottom area is reduced by 30 to 70 percent relative to the fin width in the top area.

9. The steam generator as claimed in claim 8, wherein the plurality of steam generator pipes in the bottom area are arranged substantially parallel to the direction of inclination of the funnel-shaped side walls.

10. The steam generator as claimed in claim 9, wherein the steam generator is a continuous steam generator.

11. The steam generator as claimed in claim 1, wherein the combustion chamber side walls and the encircling wall form a gas tight boundary for the ducting of a hot combustion gas.

12. The steam generator as claimed in claim 1, wherein at least one of the outermost steam generator pipes arranged at the greatest distance from the center axis A is arranged over the entire height of the funnel-shaped side walls both with non-reduced pipe diameter and non-reduced width.

13. The steam generator as claimed in claim 12, wherein the innermost steam generator pipes with the smallest distance from the center axis A are embodied over their entire length with a reduced pipe diameter and reduced width and arranged in parallel to the center axis A.

14. The steam generator as claimed in claim 13, wherein the steam generator pipes arranged between the outermost and the innermost steam generator pipes have a first section with reduced pipe diameter, and a second section with non-reduced pipe diameter.

15. A combustion chamber that combusts a fossil fuel for the generation of steam, comprising:

a top area and a bottom area where the bottom area is sized and configured for removal of accumulated ash;

a lower portion having funnel shaped side walls arranged between the top and bottom areas;

a plurality of steam generator pipes, connected together by fins, at least one of the pipes having a diameter at the bottom area that is different than a diameter at the top area;

an encircling wall arranged between the bottom and top areas and above the funnel shaped side walls formed from the plurality of steam generator pipes; and a flow medium that flows through the steam generator pipes that is heated; and a center axis A, positioned at the center of the encircling wall and extending parallel to the direction of flow of the flow medium, wherein the outermost steam generator pipes which are the greatest distance from the center axis A are arranged over the entire height of the funnel shaped side walls both with non-reduced pipe diameter and a non-reduced fin width, wherein inner most steam generator pipes with the smallest distance from the center axis A have a reduced pipe diameter and reduced fin width, and steam generator pipes arranged between the outermost and the innermost steam generator pipes form a transition having a first section with reduced pipe diameter and reduced fin width and a second section with non-reduced pipe diameter and non-reduced fin width.

* * * * *